US009057169B1

(12) United States Patent
Perko

(10) Patent No.: US 9,057,169 B1
(45) Date of Patent: Jun. 16, 2015

(54) SACRIFICIAL TIP AND METHOD OF INSTALLING A FRICTION PILE

(71) Applicant: Magnum Piering, Inc., West Chester, OH (US)

(72) Inventor: Howard A. Perko, Fort Collins, CO (US)

(73) Assignee: Magnum Piering, Inc., West Chester, OH (US)

( * ) Notice: Subject to any disclaimer, the term of this patent is extended or adjusted under 35 U.S.C. 154(b) by 0 days.

(21) Appl. No.: 14/268,204

(22) Filed: May 2, 2014

(51) Int. Cl.
*E02D 7/22* (2006.01)
*E02D 5/56* (2006.01)

(52) U.S. Cl.
CPC ... *E02D 7/22* (2013.01); *E02D 5/56* (2013.01)

(58) Field of Classification Search
CPC ..... E02D 5/56; E02D 7/22
USPC ..... 405/242, 252.1, 253, 254
See application file for complete search history.

(56) References Cited

U.S. PATENT DOCUMENTS

| | | | | | |
|---|---|---|---|---|---|
| 108,814 | A | * | 11/1870 | Moseley | 405/252.1 |
| 3,540,225 | A | * | 11/1970 | Muller | 405/242 |
| 4,266,830 | A | * | 5/1981 | Retka et al. | 175/394 |
| 4,623,025 | A | * | 11/1986 | Verstraeten | 405/253 |
| 4,708,530 | A | * | 11/1987 | Faber | 405/253 |
| 6,058,662 | A | | 5/2000 | Perko | |
| 6,722,821 | B1 | | 4/2004 | Perko et al. | |
| 7,494,299 | B1 | * | 2/2009 | Whitsett | 405/254 |
| 8,033,757 | B2 | * | 10/2011 | Stroyer | 405/253 |
| 2006/0198706 | A1 | | 9/2006 | Neville | |
| 2009/0116910 | A1 | * | 5/2009 | Whitsett | 405/252.1 |
| 2010/0310321 | A1 | * | 12/2010 | Horanek | 405/252.1 |
| 2011/0229272 | A1 | * | 9/2011 | Lindsay et al. | 405/253 |
| 2012/0087740 | A1 | * | 4/2012 | Stroyer | 405/241 |

OTHER PUBLICATIONS

Foundation Piledriving Contractors, Fundex Piles: Vibration-Free Soil Displacement Cast-In-Place Concrete Pile, http://www.foundationpiledriving.com/fundex-piles, © 2014, 4 pp.

* cited by examiner

*Primary Examiner* — Frederick L Lagman
(74) *Attorney, Agent, or Firm* — Wood Herron & Eveans LLP

(57) ABSTRACT

A sacrificial tip and method of installing a friction pile within the ground includes a connective plate to attach to a friction pile, a smaller diameter pipe extending from the plate, and a plurality of gussets and a helical flight secured to the pipe. The pipe projects generally perpendicularly from the connective plate toward a penetrative aspect and the plurality of gussets are secured to and project radially outwardly from the pipe, and extend longitudinally along the pipe tapering radially inwardly from the connective plate toward the penetrative aspect. The helical flight is secured about the pipe and spirals longitudinally toward the penetrative aspect. The connective plate can be secured to the friction pile with the pipe projecting coaxially with the friction pile to define the sacrificial tip for the friction pile.

22 Claims, 4 Drawing Sheets

SACRIFICIAL TIP AND METHOD OF INSTALLING A FRICTION PILE

TECHNICAL FIELD

The present invention relates to a sacrificial tip for a friction pile, such as a sacrificial drill tip and, more particularly, to a rotatably driven sacrificial tip and friction pile for ground anchoring and foundations.

BACKGROUND

By way of background, conventional piles are well known in the construction industry for ground anchoring and forming foundations of structures and buildings. While all piles are generally driven into the ground for installation, an augered friction pile is rotatably driven into the ground until it reaches an installation depth for a particular application or loading. Friction piles traditionally include a hollow casing and a sacrificial tip secured to and closing off the terminal end thereof. The sacrificial tip, such as a sacrificial drill tip, facilitates advancement of the friction pile into the ground and remains in the ground attached to the friction pile even after installation.

Sacrificial tips operatively advance the friction pile into the ground much like a screw or auger. For example, a rotary drill, such as a track-mounted mobile ram with a drill head, operatively rotates the friction pile and, in turn, rotates the sacrificial tip against the ground. A typical sacrificial tip may include a generally conical body, a helical flight, and a plurality of teeth. As the sacrificial tip rotates, the teeth loosen and work the ground while the helical flight engages the ground to effectively pull the conical body deeper toward the installation depth. The conical body acts as a wedge to force surrounding ground away from the terminal end of the friction pile so that the friction pile may similarly advance into the ground. Once the installation depth is reached, the friction pile and sacrificial tip remain anchored in position by the compression caused by the surrounding ground.

However, in order for the sacrificial tip to survive installation, the conical body, helical flight, and plurality of teeth must be formed from a relatively strong, durable, hard, and malleable material, such as steel. Forming steel into the conical body requires a significant amount of time, skill, and material, thereby adding cost to the sacrificial tip. Furthermore, the teeth are relatively small and may be dislodged during installation. Moreover, imperfections created during the relatively complicated and expensive manufacturing process of the sacrificial tip may lead to one or more teeth being improperly attached, and can fail to perform properly. In either situation, the ground may not be effectively loosened, which, in turn, tends to create additional mechanical stress on the remainder of the sacrificial tip, friction pile, and rotary drill. This additional mechanical stress may effectively shorten the useful life of any one of the sacrificial tip, the friction pile, or the rotary drill.

There is a need for a sacrificial tip and method for effective installation of a friction pile that addresses issues such as those discussed above.

SUMMARY

The present invention provides a sacrificial tip for a friction pile which is less costly, simpler to manufacture, and more reliable than conventional sacrificial tips. To that end, and in accordance with the present invention, the sacrificial tip includes a connective plate sized to secure to the friction pile, and a smaller diameter pipe projecting from the connective plate to a penetrative aspect, with a helical flight and several gussets secured to the pipe, the gussets extending longitudinally along the pipe and tapering radially inwardly from the plate toward the penetrative aspect. The plate, gussets, and helical flight can all be formed from relatively inexpensive plate stock, and the pipe can be formed from relatively inexpensive pipe stock manufactured in a bulk extrusion process. They can be assembled together using well-known techniques such as welding Advantageously, at least one of the gussets intersects with the helical flight, and may be secured to the helical flight thereat and/or may extend through a notch in the helical flight thereat. Further advantageously, the connective plate includes a slot, and a gusset includes a tab received in the slot to further secure the gusset to the pipe.

To install the friction pile and sacrificial tip to an installation depth, a terminal end of the friction pile is attached to the connective plate, and a driven end of the friction pile is operatively rotated by a rotary drill. At least a portion of the friction pile rotates in order to rotate the sacrificial tip while the penetrative aspect is positioned against the ground. The penetrative aspect pierces the ground, and the helical flight engages the ground. In doing so, the rotating helical flight advances the sacrificial tip further into the ground with the rotating gussets. Thus, by rotating the sacrificial tip, the pipe and gussets respectively pierce and clear ground from the terminal end of the friction pile similar to the teeth and conical body of conventional sacrificial tips, but with improved manufacturability, cost, and reliability. Once driven to the installation depth, the sacrificial tip remains attached to the friction pile within the ground for forming a portion of a building foundation or other ground anchoring application.

By virtue of the foregoing, there is thus provided a sacrificial tip which is simpler to manufacture, less costly, and more reliable than conventional sacrificial tips. These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with the general description given above and the detailed description of the embodiments given below, serve to explain the principles of the invention.

DETAILED DESCRIPTION OF THE DRAWINGS

Figure 1:
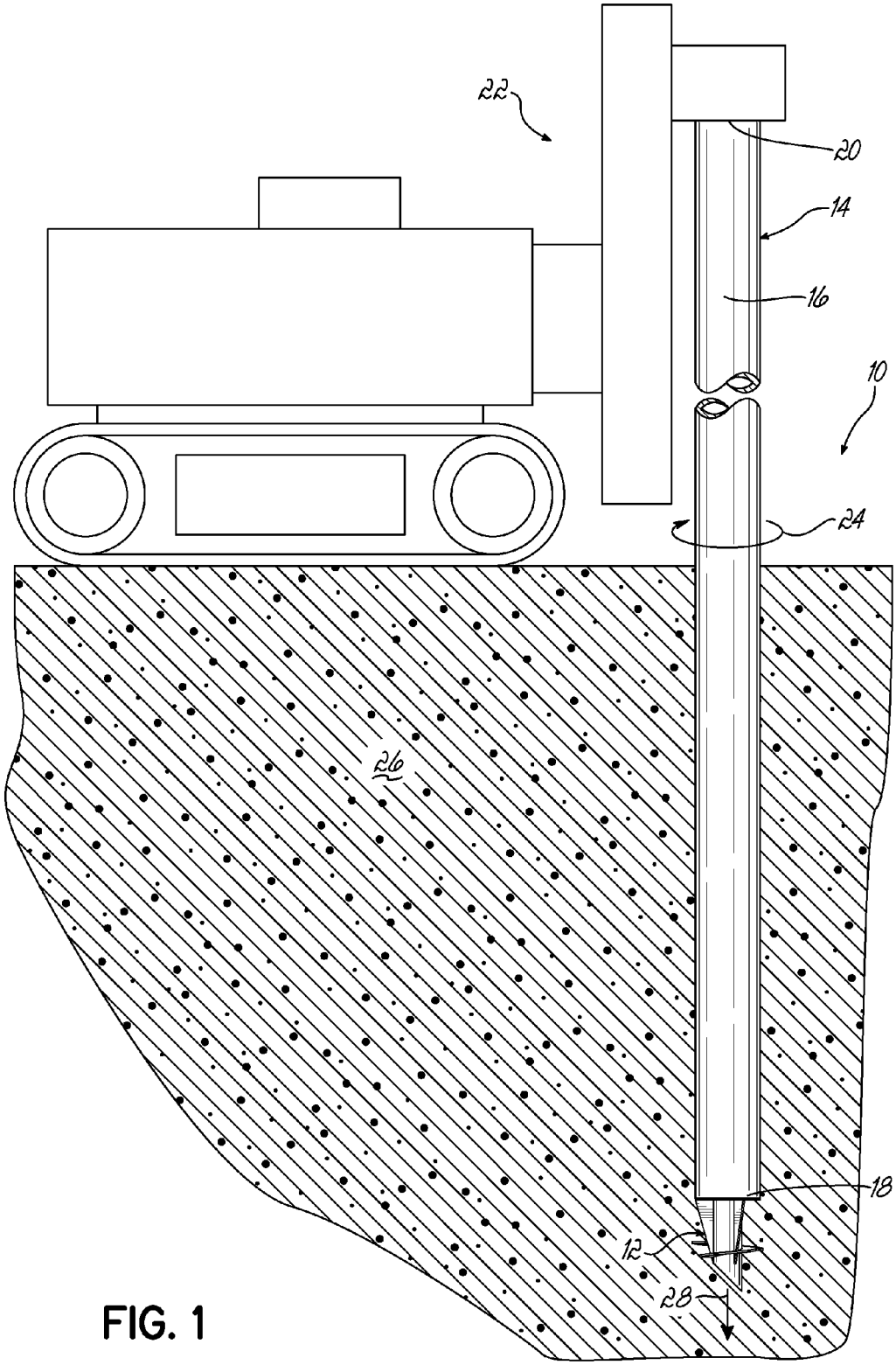
FIG. 1 is a front view of an embodiment of a sacrificial tip secured to a friction pile being driven into the ground by a schematic rotary drill for reference.

In reference to FIG. 1, an apparatus 10 in accordance with various features of the present invention includes a sacrificial tip 12 rigidly secured to a friction pile 14. The friction pile 14 has a hollow casing 16 that extends between a terminal end 18 and an oppositely disposed driven end 20. A rotary drill 22, or similar mechanism for rotating and driving the friction pile 14, is operatively connected to the driven end 20 of the friction pile 14. The rotary drill 22 operatively engages the driven end 20 of the friction pile 14 to rotate the friction pile 14 clockwise when viewed from above, as indicated by arrow 24. In turn, the terminal end 18 rotates the sacrificial tip 12 clockwise into engagement with the ground 26. While rotating, the sacrificial tip 12 and friction pile 14 move downward into the ground 26, as indicated by arrow 28, until the apparatus 10 reaches an installation depth for anchoring the sacrificial tip 12 and friction pile 14 into the ground 26. As shown in FIG. 1, the friction pile 14 may be any length for reaching the installation depth. Similarly, the friction pile 14 may be formed from one or more sections so that a first section, having the terminal end 18, is driven into the ground 26 followed by another section connected thereto. These sections of the friction pile 14 may be hollow, as shown, or solid and may be connected in series to drive the sacrificial tip 12 to any depth within the ground 26 to the installation depth. In this respect, it will be appreciated that any other pile may be similarly configured for connection to the sacrificial tip 12, and the invention is not intended to be limited to use with the friction pile 14 shown in FIG. 1.

Figure 2A:
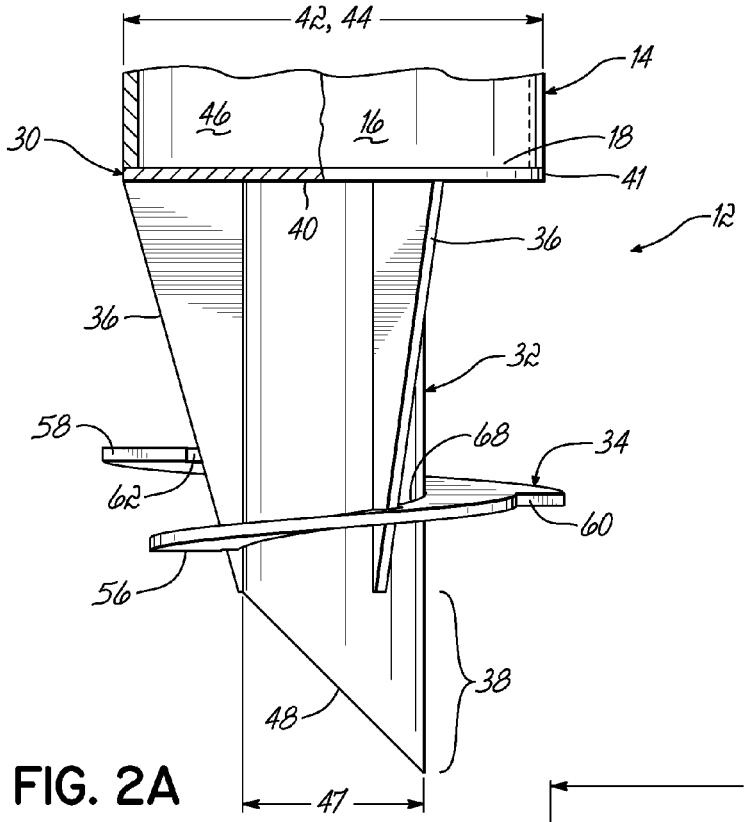
FIG. 2A is an enlarged sectional side view of the sacrificial tip and friction pile of FIG. 1.

FIG. 2A shows an exemplary embodiment of the sacrificial tip 12 rigidly secured to the terminal end 18 of the friction pile 14. The sacrificial tip 12 generally includes a connective plate 30, a pipe 32 projecting generally perpendicularly from the connective plate 30, a helical flight 34 secured about the pipe 32, and a plurality of gussets 36 extending along the pipe 32. Additionally, the sacrificial tip 12 includes a penetrative aspect 38 oppositely disposed from the connective plate 30 that will be discussed further below.

In order to rigidly attach and mate the sacrificial tip 12 to the friction pile 14, a plurality of welds (not shown) secure the connective plate 30 to an annular end face 40 of the terminal end 18. More particularly, the connective plate 30 has an outer plate edge 41 that defines a plate diameter 42 and is generally circular, whereas the annular end face 40 defines a pile diameter 44 that is also generally circular. The connective plate 30 is welded directly to the annular end face 40 with the plate diameter 42 and pipe 32 coaxially aligned with the pile diameter 44 and covering an interior space 46 of the friction pile 14. As such, the alignment between the outer plate edge 41 and the annular end face 40 is generally smooth and essentially free of lips or stepped edges. According to an exemplary embodiment, the plate diameter 42 is between 5 inches and 12 inches and, more particularly, between 7 inches and 10 inches. Even more particularly, the plate diameter 42 is approximately 8⅝ inches. With respect to an exemplary embodiment of the friction pile 14, the pile diameter 44 is between 5 inches and 12 inches and, more particularly, between 7 inches and 10 inches. Even more particularly, the plate diameter 42 is approximately 8⅝ inches.

Figure 2B:
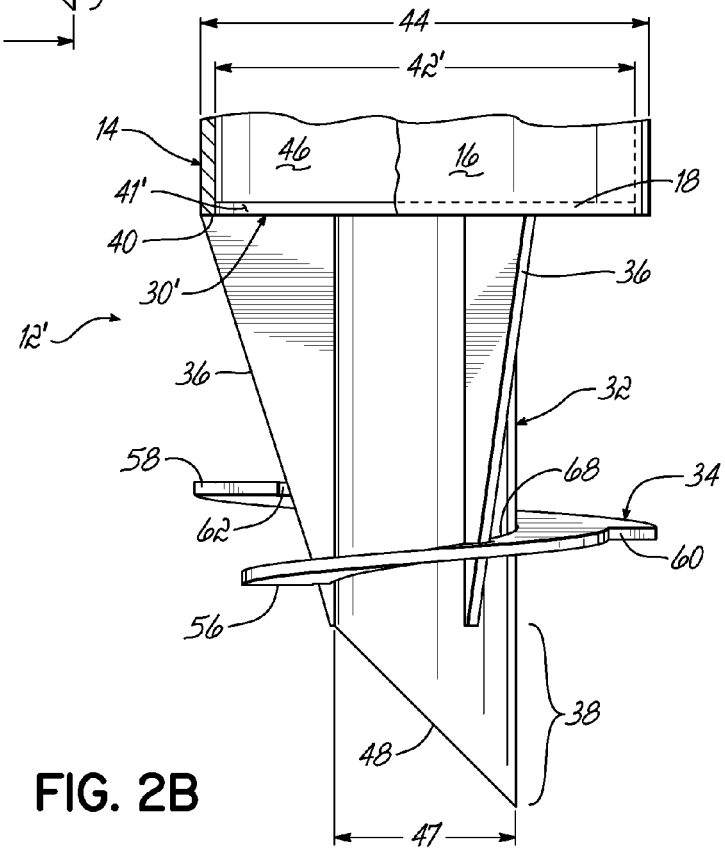
FIG. 2B is an enlarged sectional side view of another embodiment of a sacrificial tip and friction pile.
Figure 3:
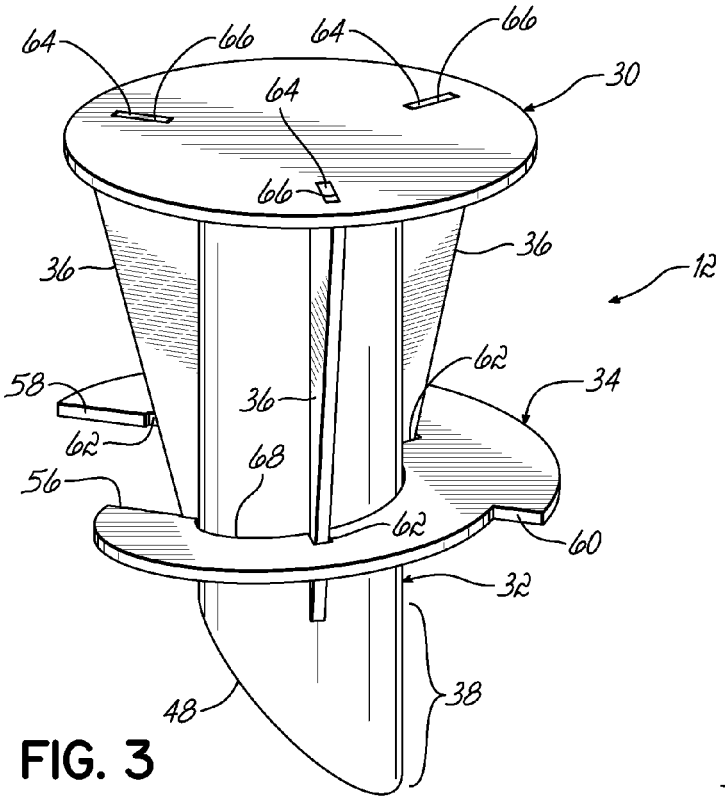
FIG. 3 is an upper perspective view of the sacrificial tip of FIG. 2A.
Figure 4:
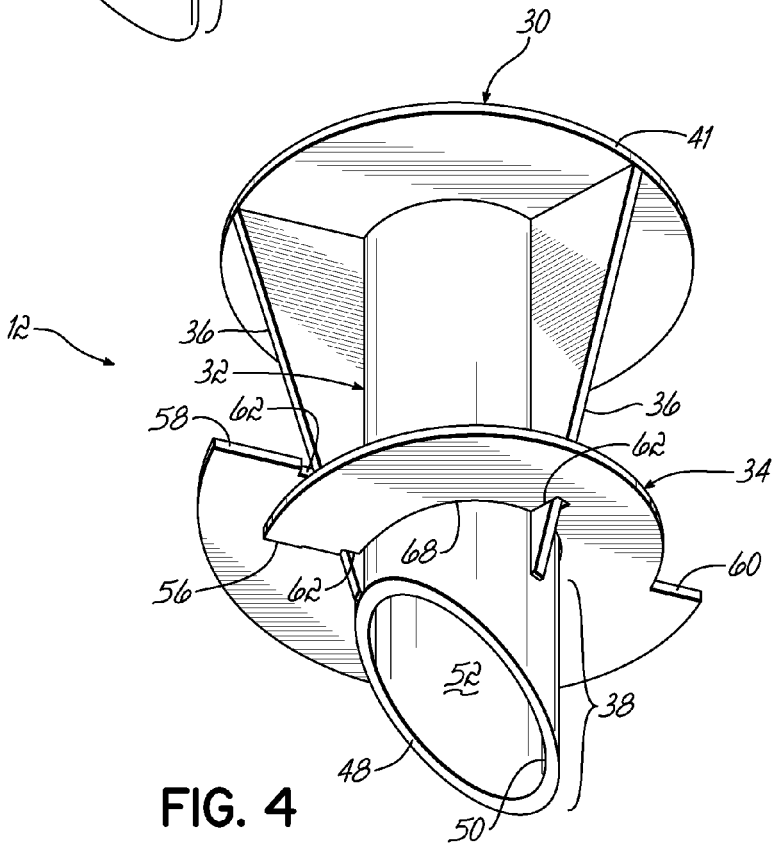
FIG. 4 is a lower perspective view of the sacrificial tip of FIG. 2A.

FIG. 2B shows an alternative embodiment of a sacrificial tip 12' in which a connective plate 30' with an outer plate edge 41' defines a smaller plate diameter 42' relative to the pile diameter 44 discussed above. In this respect, like numbers indicate like features described herein. In contrast to the connective plate 30 (See FIG. 2A), the connective plate 30' is sized for insertion into the interior space 46, while still covering the interior space 46. In other words, the connective plate 30' is recessed into the interior space 46 and the outer plate edge 41' is welded to the terminal end 18 within the interior space 46. The plate diameter 42' is generally circular and coaxially aligns with the pile diameter 44, such that the alignment between the recessed connective plate 30' and the annular end face 40 is generally smooth and essentially free of lips or stepped edges. According to an exemplary embodiment, the plate diameter 42' is between 5 inches and 12 inches and, more particularly, between 7 inches and 10 inches. Even more particularly, the plate diameter 42' is less than 8⅝ inches.

While FIG. 2A and FIG. 2B show two exemplary embodiments of the sacrificial tip 12, 12', it will be appreciated to one of ordinary skill in the art that the sacrificial tips 12, 12' may be rigidly attached to the friction pile 14 using other known methods of mechanical attachment. The connective plates 30, 30' may also be any shape and still define an outer diameter similar to the plate diameter 42, 42' described above. Furthermore, alternative embodiments of the invention may include a lip or stepped edge between the friction pile 14 and sacrificial tip 12, 12'. Thus, it is not intended that the invention necessarily be limited to the attachment between the sacrificial tip 12, 12' and friction pile 14 described above.

FIG. 2A, and FIGS. 3-5B show the sacrificial tip 12 having the connective plate 30, the pipe 32, the helical flight 34, and the plurality of gussets 36 described briefly above. The pipe 32 projects opposite from the friction pile 14 and to the penetrative aspect 38. The pipe 32 is generally cylindrical and defines a pipe diameter 47 smaller than the plate diameter 42. The pipe diameter 47 is between 1 inch and 5 inches and, more particularly, between 2 inches and 4 inches. Even more particularly, the pipe diameter 47 is approximately 3 inches and constant along the entirety of the pipe 32. The penetrative aspect 38 is an elliptical beveled end 48 defining an opening 50 into a hollow 52 of the pipe 32. As such, the pipe 32 extends approximately 14 inches from the connective plate 30, along the penetrative aspect 38, to the beveled end 48. According to an exemplary embodiment, the beveled end 48 extends along the penetrative aspect 38 at approximately 45° from the longitudinal direction of the pipe 32.

The plurality of gussets 36 are secured to and positioned about the pipe 32 for providing structural rigidity to the sacrificial tip 12 and clearing the ground 26 away from the terminal end 18 of the friction pile 14, as shown in FIG. 1. With respect to FIG. 2A and FIGS. 3-5B, an exemplary embodiment of the sacrificial tip 12 includes three gussets 36 extending longitudinally along the pipe 32 from the connective plate 30 toward the penetrative aspect 38. Each gusset 36 projects radially outwardly from the pipe 32, but tapers radially inwardly from the connective plate 30 toward the penetrative aspect 38. According to an exemplary embodiment, the gussets 36 are generally in the form of a right triangle and extend radially outward to at least the outer plate edge 41.

The gussets 36 taper radially inwardly at a constant slope such that the gussets 36 define a gusset diameter that is transverse to the longitudinal direction of the pipe 32. The gusset diameter generally decreases from the connective plate 30 to the penetrative aspect 38. Thus, when the gussets 36 rotate, the gussets 36 collectively define a frustoconical shape positioned coaxial to the pipe 32, friction pile 14, and the connective plate 30. Notably, the largest gusset diameter of the sacrificial tip 12 is approximately equal to the pile diameter 44. The plurality of gussets 36 extend to the penetrative aspect 38, but do not extend longitudinally further along the penetrative aspect 38. Alternatively, one or more of the gussets 36 may extend along the penetrative aspect 38.

In addition, the gussets 36 are equiangularly spaced from one another about the pipe 32. As such, an exemplary embodiment has each gusset 36 angularly spaced approximately 120° from the nearest gusset 36. Alternatively, any other number of gussets 36 may extend along the pipe 32 and may be spaced with different or like angles relative to each other. Thus, it will be appreciated that the invention is not intended to be limited to three gussets 36 spaced equiangularly as described herein.

The helical flight 34 secured about the pipe 32 spirals longitudinally along the pipe 32 toward the penetrative aspect 38. More particularly, the helical flight 34 is a right-handed helicoid that extends continuously from a first leading edge 56 to a trailing edge 58. The helical flight 34 defines an outer flight diameter 59 and a pitch from the first leading edge 56 to the trailing edge 58 that, when rotated as described below, engages the ground 26 (See FIG. 1). The outer flight diameter 59 is transverse the longitudinal direction of the pipe 32 and larger than the plate diameter 42. According to an exemplary embodiment, the outer flight diameter 59 is between 10 inches and 18 inches and, more particularly, between 12 and 16 inches. Even more particularly, the outer flight diameter 59 is approximately 14 inches.

The helical flight 34 further includes a second leading edge 60 along the helical flight 34 between the first leading edge 56 and the trailing edge 58. The second leading edge 60 projects radially outward from the pipe 32 further than the first leading edge 56 and, as such, the helical flight 34 between the first and second leading edges 56, 60 defines a smaller radial diameter than a larger radial diameter defined by the helical flight 34 between the second leading and trailing edge 60, 58. In this way, the first leading edge 56 is generally smaller than the second leading edge 60 for slicing into the ground 26 (See FIG. 1), whereas the larger radial diameter extending from the second leading edge 60 to the trailing edge 58 provides increased surface area for greater engagement with the ground 26 (See FIG. 1).

As shown in FIG. 2A and FIGS. 3-5B, the first leading edge 56 of the helical flight 34 initiates adjacent to one of the gussets 36. From the first leading edge 56, the helical flight 34 spirals approximately one revolution, or approximately 360°, with a predetermined pitch about the pipe 32 toward the connective plate 30. As such, the trailing edge 58 terminates adjacent to the same gusset 36 from which the first leading edge 56 is initiated. Furthermore, the second leading edge 60 is positioned on the helical flight 34 approximately one-half revolution, or approximately 180°, from the first leading edge 56 and the trailing edge 58.

A plurality of notches 62 extend through helical flight 34 and respectively receive the plurality of gussets 36. In this respect, the gussets 36 effectively intersect the helical flight 34 so that an inner edge 68 of the helical flight 34 may abut directly against the pipe 32. According to an exemplary embodiment, the helical flight 34 includes four notches 62 along the one revolution of helical flight 34. More particularly, the first leading edge 56 and trailing edge 58 each include one notch 62 to receive the same adjacent gusset 36. The remaining two notches 62 are spaced equiangularly from each other to receive the remaining gussets 36 approximately 120° apart. Of course, due to the increasing slope of the gussets 36 described above, the notches 62 increase in size from the first leading edge 56 to the trailing edge 58 to receive the radially tapering gussets 36.

Figure 5A:
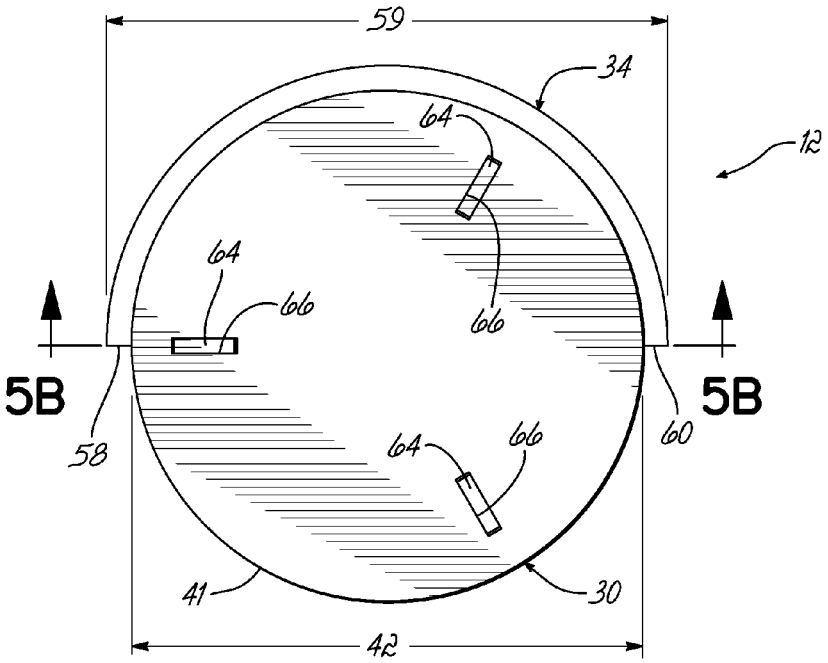
FIG. 5A is a top view of the sacrificial tip of FIG. 2A.
Figure 5B:
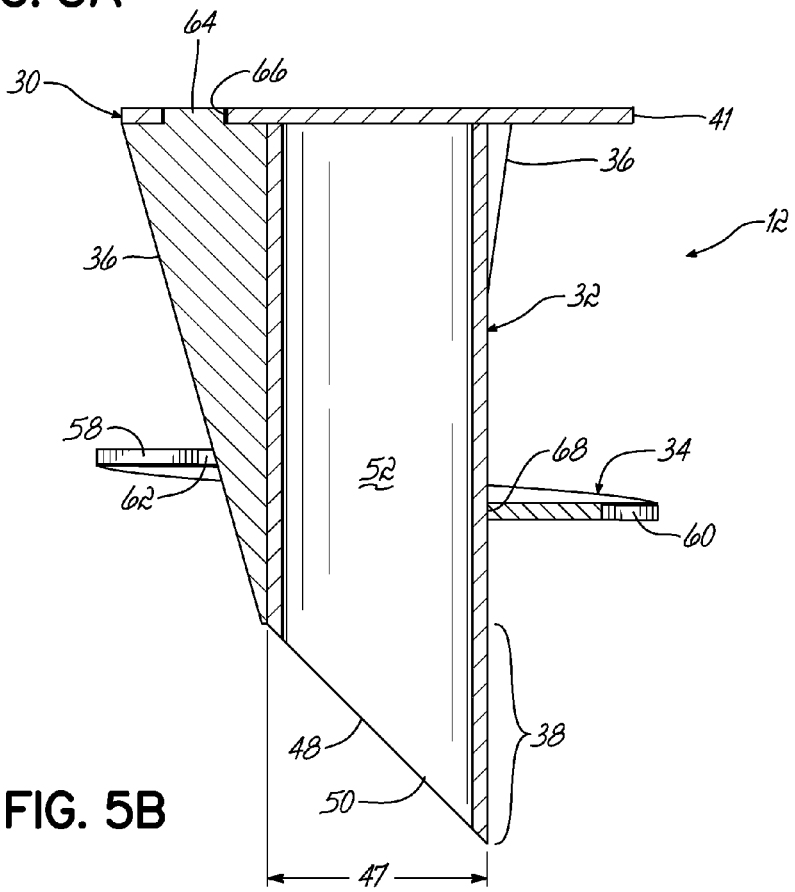
FIG. 5B is a cross-sectional view of the sacrificial tip taken along line 5B-5B of FIG. 5A.

As shown in FIG. 5A and FIG. 5B, each gusset 36 includes a tab 64 that cooperates with a slot 66 in the connective plate 30 for rigidly securing the gussets 36 to the connective plate 30. Accordingly, the connective plate 30 includes three slots 66, equiangularly spaced from each other to align with the gussets 36, for respectively receiving each tab 64. The tab 64 extends from the gusset 36 and into the slot 66. The tabs 64 may be welded, slip fit, or friction fit into the slots 66 so long as the tabs 64 and slots 66 cooperate to inhibit torsional bending of the remaining sacrificial tip 12 during use. In order to provide further strength and rigidity to the remainder of the sacrificial tip 12, the connective plate 30, the gussets 36, and the helical flight 34 are all welded to the pipe 32. In addition, the helical flight 34 and the connective plate 30 are each further welded to the gussets 36. As such, the connective plate 30, the gussets 36, and the helical flight 34 may each be formed from plates of metal, whereas the pipe 32 may be formed from extruded metal. In either case, the metal may be steel or other relatively strong, durable, hard, and malleable material. According to an exemplary embodiment, the pipe 32 is formed from steel having material properties in accordance with standard ASTM A513, whereas the gussets 36, connective plate 30, and helical flight 34 are formed from steel having material properties in accordance with standard ASTM A36. For the exemplary steel construction, the pipe 32, gussets 36, plate 30, and helical flight 34 are preferably assembled with a weld of E70 or better.

In use, the apparatus 10 having the sacrificial tip 12 rigidly secured to the terminal end 18 of the friction pile 14 is rotatably driven into engagement with the ground 26, as shown in FIGS. 1-5B. At least a portion of the friction pile 14 is rotatably connected to the rotary drill 22. Similarly, the sacrificial tip 12 is rigidly secured to the terminal end 18 of the friction pile 14. As such, the rotary drill 22 operatively rotates the sacrificial tip 12 clockwise while positioning the penetrative aspect 38 against the ground 26. The rotating penetrative aspect 38 pierces the ground 26 while the first leading edge 56 slices into the ground 26. As the first leading edge 56 rotates and slices into the ground 26, the remainder of the helical flight 34 engages the ground 26 and rotatably advances into the ground 26. In turn, the helical flight 34 effectively forces the penetrative aspect 38 into the ground 26, as indicated by arrow 28, to pierce further into the ground 26.

The rotating pipe 32 causes the plurality of gussets 36 to similarly rotate within the ground 26. The rotating gussets 36 effectively loosen and clear a portion of the ground 26 from the terminal end 18 so that the connective plate 30 and friction pile 14 follow behind. As the pipe 32 moves into the ground 26, another portion of the ground 26 is forced through the opening 50 and into the hollow 52 within the pipe 32. Of course, once the hollow 52 fills with the ground 26, other portions of the ground 26 are simply deflected around the pipe 32 and cleared away by the rotating plurality of gussets 36. The plurality of gussets 36 clear the portion of the ground 26 from the terminal end 18, but maintain a sufficient amount of ground 26 around the friction pile 14 to compress the friction pile 14 with the surrounding ground 26.

The rotary drill 22 continues to rotate the friction pile 14 and sacrificial tip 12 as described above until the sacrificial tip 12 reaches the installation depth for anchoring into the ground 26. Rather than remove the sacrificial tip 12, the attachment of the sacrificial tip 12 to the terminal end 18 is maintained once the installation depth is reached. Thus, the apparatus 10 at the installation depth is effectively installed for forming a portion of a building foundation or other ground anchoring application.

While the present invention has been illustrated by embodiments thereof, and while the embodiments have been described in considerable detail, they are not intended to restrict or in any way limit the scope of the appended claims to such detail. The various features shown and described herein may be used alone or in any combination. Additional advantages and modifications will readily appear to those skilled in the art. For example, the sacrificial tip may not include cooperating tabs and slots and may instead be assembled with welds and/or fasteners. Also, various features of the prior art, such as teeth, may be secured to or form a portion of the sacrificial tip. Furthermore, the penetrative aspect may be conical, serrated, pointed, sharp, or generally any other shape for piercing the ground. While the gussets shown and described above are generally triangular and planar, it will be further appreciated that the gussets may alternatively be bent, arcuate, or another shape that may be positioned about the pipe. In this respect, it will be appreciated that the particular sizes and shapes discussed above may be augmented or scaled to accommodate other sizes or types of piles, or even other soil types and applications. The invention in its broader aspects is, therefore, not limited to the specific details, representative apparatus and method and illustrative examples shown and described. Accordingly, departures may be from such details without departing from the scope of the general inventive concept.

Having described the invention, what is claimed is:

1. A sacrificial tip for a friction pile, comprising;

a connective plate defining a first diameter and configured for mating with said friction pile;

a pipe projecting generally perpendicularly from the connective plate toward a penetrative aspect, the penetrative aspect oppositely disposed from the connective plate, and the pipe having a second diameter smaller than the first diameter;

a plurality of gussets secured to and positioned about the pipe, each gusset projecting radially outwardly from the pipe and extending longitudinally along the pipe, each gusset tapering radially inwardly from the connective plate toward the penetrative aspect; and a helical flight secured about the pipe and spiraling longitudinally therealong toward the penetrative aspect, whereby securing the connective plate to said friction pile with the pipe projecting coaxially with said friction pile defines the sacrificial tip for said friction pile, wherein at least one of the gussets intersects with the helical flight.

2. The sacrificial tip of claim 1 wherein the pipe is hollow.

3. The sacrificial tip of claim 1 wherein the helical flight includes a first leading edge and a trailing edge, and the helical flight is continuous from the first leading edge to the trailing edge.

4. The sacrificial tip of claim 3 wherein the helical flight includes a second leading edge projecting radially outward from the helical flight further than the first leading edge between the first leading and trailing edges.

5. The sacrificial tip of claim 3 wherein the helical flight spirals one revolution about the pipe from the first leading edge to the trailing edge.

6. The sacrificial tip of claim 5 wherein the first leading edge initiates adjacent to a first of the gussets and the trailing edge terminates adjacent to the first of the gussets.

7. The sacrificial tip of claim 1 wherein the helical flight secures to at least one of the gussets at an intersection of the at least one of the gussets and the helical flight.

8. The sacrificial tip of claim 1 further comprising at least one notch extending through the helical flight, wherein the at least one notch receives the at least one of the gussets, respectively, where the at least one of the gussets intersects with the helical flight.

9. The sacrificial tip of claim 1 wherein at least one of the gussets includes a tab and the connective plate includes at least one slot, and the at least one slot receives the tab to further secure at least one of the gussets to the pipe.

10. The sacrificial tip of claim 1 wherein the plurality of gussets are equiangularly spaced about the pipe.

11. The sacrificial tip of claim 10 wherein the plurality of gussets is three gussets.

12. The sacrificial tip of claim 1 wherein the connective plate includes an outer plate edge, and the plurality of gussets project radially outward to at least the outer plate edge.

13. The sacrificial tip of claim 1 wherein the helical flight defines a third diameter larger than the first diameter.

14. The sacrificial tip of claim 1 wherein the penetrative aspect of the pipe is a beveled end.

15. An apparatus for forming a foundation in the ground, comprising;

at least a portion of a friction pile including a terminal end; and a sacrificial tip, comprising;

a connective plate defining a first diameter;

a pipe projecting generally perpendicularly from the connective plate toward a penetrative aspect, the penetrative aspect oppositely disposed from the connective plate, and the pipe having a second diameter smaller than the first diameter;

a plurality of gussets secured to and positioned about the pipe, each gusset projecting radially outwardly from the pipe and extending longitudinally along the pipe, each gusset tapering radially inwardly from the connective plate toward the penetrative aspect; and a helical flight secured about the pipe and spiraling longitudinally therealong toward the penetrative aspect, whereby securing the connective plate to the friction pile with the pipe projecting coaxially with the friction pile defines the sacrificial tip for said friction pile, wherein at least one of the gussets intersects with the helical flight.

16. The apparatus of claim 15 wherein the terminal end includes an annular end face and the connective plate attaches to the annular end face.

17. The apparatus of claim 16 wherein the terminal end defines a pile diameter approximately equal to the first diameter.

18. The apparatus of claim 15 wherein the terminal end includes an interior space and the connective plate is attached to the terminal end within the interior space.

19. A method of installing a friction pile with a pile diameter attached to a sacrificial tip in the ground, the sacrificial tip comprising a connective plate, a pipe, a plurality of gussets, and a helical flight, the connective plate defining a first diameter, the pipe projecting generally perpendicularly from the connective plate toward a penetrative aspect oppositely disposed from the connective plate, the pipe having a second diameter smaller than the first diameter, the plurality of gussets being secured to and positioned about the pipe, each gusset projecting radially outwardly from the pipe and extending longitudinally along the pipe, each gusset tapering radially inwardly from the connective plate toward the penetrative aspect, and the helical flight secured about the pipe and spiraling longitudinally along the pipe and toward the penetrative aspect, the method comprising;

rotating at least a portion of the friction pile in order to rotate the sacrificial tip attached to a terminal end of the friction pile;

positioning the penetrative aspect against the ground and piercing the ground with the penetrative aspect;

engaging the ground with the helical flight and rotating the helical flight relative to the ground such that the helical flight advances the sacrificial tip into the ground, at least one of the gussets intersecting with the helical flight;

rotating the plurality of gussets and clearing a portion of the ground from the terminal end with the plurality of gussets until at least the portion of the friction pile is installed within the ground; and maintaining attachment of the sacrificial tip to the terminal end of the friction pile and leaving the sacrificial tip in the ground.

20. The method of claim 19 further comprising receiving another portion of the ground within a hollow of the pipe when piercing the ground.

21. The method of claim 19 wherein the terminal end includes an annular end face and the method further comprises attaching the connective plate to the annular end face.

22. The method of claim 19 wherein the terminal end includes an interior space and the method further comprises attaching the connective plate to the terminal end within the interior space.

* * * * *